US005790090A

United States Patent [19]

Libsch et al.

[11] Patent Number: 5,790,090

[45] Date of Patent: Aug. 4, 1998

[54] ACTIVE MATRIX LIQUID CRYSTAL DISPLAY WITH REDUCED DRIVE PULSE AMPLITUDES

[75] Inventors: Frank Robert Libsch, White Plains; Eugene Stewart Schlig, Somers, both of N.Y.

[73] Assignee: International Business Machines Corporation, Armonk, N.Y.

[21] Appl. No.: 730,986

[22] Filed: Oct. 16, 1996

[51] Int. Cl.[6] ..... G09G 3/36

[52] U.S. Cl. ..... 345/94; 345/98; 345/99

[58] Field of Search ..... 345/90–100

[56] References Cited

U.S. PATENT DOCUMENTS

| | | | |
|---|---|---|---|
| 4,621,260 | 11/1986 | Suzuki et al. | 340/719 |
| 4,842,371 | 6/1989 | Yasuda et al. | 350/333 |
| 5,095,304 | 3/1992 | Young | 340/766 |
| 5,151,805 | 9/1992 | Takeda et al. . | |
| 5,185,601 | 2/1993 | Takeda et al. | 340/784 |
| 5,247,289 | 9/1993 | Matsueda | 345/98 |
| 5,568,163 | 10/1996 | Okumura | 345/100 |

*Primary Examiner*—Steven J. Saras
*Assistant Examiner*—David L. Lewis
*Attorney, Agent, or Firm*—Scully, Scott, Murphy and Presser

[57] ABSTRACT

An active matrix liquid crystal display (AMLCD) and driving method is disclosed. The AMLCD has matrix-arranged pixel assemblies each having display electrodes. A gate line for carrying gate line pulses is connected to a control port of a row of semiconductor devices, which may be thin film transistors (TFTs). Each TFT has an output port connected to the display electrodes. In addition, a data line is connected to an input port of a column of the TFTs. A bootstrap line is capacitively connected to the display electrodes of adjacent rows. This reduce the number of bootstrap lines to half the number of gate and data lines. A bootstrap pulse timing and generating circuit is connected to the bootstrap line to provide a bootstrap pulse that shifts voltages on the display electrodes in only one direction. The bootstrap pulse has a first edge of a first polarity occurring before or during gate pulses carried on a gate line, and a second edge of a second polarity occurring after the gate line pulses.

8 Claims, 3 Drawing Sheets

123
Data Line Signal
162
2.5 V
0 V 120
148
Row A
Gate Line
Pulses
160
T1 T2
T3 T4
T6

130
Row B
Gate Line
Pulses
170
T5

122
125
Rows A and B
Bootstrap Line Pulses
177
180
142
8 V
0 V

140
Row A Pixel
Electrode Response
185'
185
165
10.0 V
7.5 V
2.5 V
0 V

150
Row B Pixel
Electrode Response
175
190'
190
145
147
T1 T2
T3 T4T5
T6
10.0 V
7.5 V
2.5 V
0 V Row C
Gate Line
Pulses Row D
Gate Line
Pulses Rows C and D
Bootstrap Line Pulses
8 V
0 V

ACTIVE MATRIX LIQUID CRYSTAL DISPLAY WITH REDUCED DRIVE PULSE AMPLITUDES

BACKGROUND OF THE INVENTION

1. Field of the Invention

The present invention is directed to an active matrix liquid crystal display (AMLCD) and a method for driving thereof, and more particularly, to an AMLCD and driving method having reduced drive pulse amplitudes.

2. Discussion of the Prior Art

FIG. 1 shows a circuit for a conventional AMLCD 10. The conventional AMLCD 10 has rows 12 and columns 13 of pixel assemblies 14 that include transistors Q, pixels 50 and storage capacitors 35. Columns of data lines 15 are connected to inputs 20 of a column of transistors Q, and rows of gate lines 25 ire connected to gates 30 of a row of transistors Q. The transistors Q are often thin film transistors (TFTs).

In addition, in each pixel assembly 14, a storage capacitor 35 has one terminal connected to the transistor output 40 and to a pixel or display electrode 45 of a liquid crystal (LC) pixel or display element 50. The other terminal of the storage capacitor 35 is referred to as a storage capacitor electrode 55. In various prior art configurations, the storage capacitor electrodes 55 are connected as follows: to a fixed common potential, e.g., ground; to a common pulse source; to the gate line of an adjacent row; or to additional lines, each common to a row of pixels, such as-pixel lines 65 shown in FIG. 1. Each such additional line 65 may be connected to a signal source. An LC electrode that is located opposite the pixel electrodes 45 and is common to all pixels, is referred to as common electrode 60. Each pixel 50 has its own TFT Q and storage capacitor electrode 55. Common electrode 60 is generally a layer of transparent conductive material on a separate transparent substrate. Liquid crystal material is disposed in the space between the pixel electrodes and common electrode, and is electrically insulated from both.

In the conventional AMLCD 10, the amplitude of the gate line pulse is constrained by the need to turn on the pixel transistor Q hard enough to charge the pixel 50 rapidly over the range of data line voltages, and to turn it off hard enough to avoid excessive leakage over the range of pixel voltages. The voltage across the liquid crystal 50, between the pixel electrode 45 and the common electrode 60, must be inverted in polarity periodically.

With conventional methods using a fixed voltage on the common electrodes 60, both the data line 15 and the pixel electrode 45 have a voltage range including both polarities of the voltage across the liquid crystal 50. This voltage range is about 10 volts for the typical twisted nematic (TN) liquid crystals (LCs) used in active matrix displays, i.e., plus and minus 5 volts relative to the common electrode 60. Adding allowances for threshold and overdrive, the required amplitudes of gate pulses on the gate line 25 are often over 25 volts for proper display operation with amorphous silicon (a-Si) TFTS. In the conventional AMLCD 10, the required gate pulse amplitudes are too large to be generated by circuits formed with narrow line-width MOS technologies.

In displays involving a-Si TFT arrays on a glass substrate, with separate gate driver chips, the problem of generating large amplitude gate pulses is solved by fabricating the driver chips with high-voltage, low density technologies. However, the use of such technologies increases the cost of the driver chips, and thus, the cost of such displays are also increased.

Other displays, particularly projection displays using active matrix light valves, have gate drivers integrated with the array. In such displays where gate drivers are integrated with the array, and particularly in a reflective projection display which is integrated together with driver circuits on a crystalline silicon (c-Si) substrate, the size and cost increase inherent in the use of high-voltage technologies are serious problems.

One method to reduce the data line voltage range includes pulsing the common electrode 60 and the storage capacitor electrodes 55 using a common pulse source. However, while such a method reduces the data line voltage range, this method also increases the pixel voltage range and leaves the gate line voltage range unchanged.

In other schemes, the pixel line 65 is a pulsed independent storage capacitance line for each row of pixels, together with a fixed voltage on the common or counter electrode 60. Some of these schemes reduce the data, pixel and gate line voltage ranges, but the gate line voltage reduction is insufficient. One such scheme is discussed in U.S. Pat. No. 5,151,805, issued on Sep. 29, 1992, to E. Takeda et al., entitled "Capacitively Coupled Driving Method for TFT-LCD to Compensate For Switching Distortion and to Reduce Driving Power". With the method of Takeda et al., the pixel voltage range at the pixel electrode 45 remains 10 volts, as in other conventional methods. However, the required voltages on the data and gate lines 15, 25 of the-Takeda et al. scheme are reduced. In the Takeda et al. scheme, if the pixel voltage at electrode 45 must swing from 0 to 10 volts, then the data line voltage swings from 3.75 to 6.25 volts. Thus, the maximum voltage supplied to the data line 15 is reduced from 10 volts to 6.25 volts. As a result, the gate pulse amplitude can be reduced by 3.75 volts (V).

A further reduction in the gate line voltage is desirable, especially for AMLCDs using narrow line-width MOS technologies, and for AMLCD projection displays that are integrated with drive circuits into a silicon chip.

SUMMARY OF THE INVENTION

The object of the present invention is to reduce the gate line voltage an AMLCD.

Another object of the present invention is to reduce the data line voltage of an AMLCD.

Yet another object of the present invention is to reduce power consumption of displays.

A further object of the present invention is to reduce cost and complexity of AMLCD drive electronics.

In accomplishing these objectives, the present invention preserves a proper liquid crystal operating voltage range and image frame rate, and preserves a balance of positive and negative voltages across the liquid crystal to avoid undesirable DC voltage components.

These and other objects of the present invention are achieved by a display comprising pixel assemblies arranged in a matrix of rows and columns. Each pixel assembly includes a display element having a display electrode, and a semiconductor device having a control port, an input port, and an output port. Each of the output ports is connected to a corresponding display electrode. Illustratively, the semiconductor devices are thin film transistors (TFTs).

A plurality of bootstrap, gate, and data lines are provided. Each bootstrap line is connected, e.g., capacitively connected, to the display electrodes of at least two rows of the pixel assemblies. Each gate line is connected to the control ports arranged in one of the rows. In addition, each data line is connected to the input ports arranged in one of the column.

Sharing bootstrap lines between two or more rows reduces the number of bootstrap lines to half, or less than half, the number of gate lines. Each bootstrap line is connected to a bootstrap pulse timing and generating circuit to provide a bootstrap pulse that shifts voltages on the pixel or display electrodes in only one direction, e.g. in the positive direction. Illustratively, the bootstrap pulse has a first edge of a first polarity occurring immediately before or during gate pulses carried on the gate line, and a second edge of a second polarity occurring after the gate line pulses, so that only the second edge acts to shift the voltage on the display electrode.

The bootstrap pulse timing and generating circuit may be designed in any of a number of ways known to those skilled in the art, thus its design is not a part of this invention. By way of example, its design may be generally similar to that of the gate pulse timing and generating circuit.

In another embodiment, a method of driving a display comprises the steps of:

generating a bootstrap pulse on bootstrap lines, each connected to display electrodes of at least two rows of a plurality of display elements of pixel assemblies arranged in a matrix of rows and columns;

generating gate pulses on gate lines, each connected to control ports of semiconductor devices of the pixel assemblies arranged in said rows, each of the semiconductor devices having an output port connected to a corresponding display electrode; and generating data pulses on data lines each connected to input ports of the semiconductor devices arranged in said columns.

Another embodiment includes generating a bootstrap pulse on bootstrap lines, each connected to display electrodes of a row of pixel assemblies. The bootstrap pulse has a first edge of a first polarity occurring before or during gate pulses carried on the gate line, and a second edge of a second polarity occurring after the gate line pulses.

The inventive AMLCD and drive method reduce both the data line voltage and the gate line voltage, with a low pixel voltage and a fixed common electrode voltage. This reduces complexity, power consumption, size and cost of AMLCD drive electronics. The inventive AMLCD and drive method have the lowest overall drive voltage requirements. Because of the reduced pulse amplitudes, the inventive AMLCD is suitable for narrow line-width MOS technologies.

The inventive AMLCD and drive method are particularly important when the drive electronics are integrated with the display, such as for AMLCD projection displays that are integrated with drive circuits into a silicon chip, or onto the display substrate.

BRIEF DESCRIPTION OF THE DRAWINGS

Further features and advantages of the invention will become more readily apparent from a consideration of the following detailed description set forth with reference to-the accompanying drawings, which specify and show preferred embodiments of the invention, wherein like elements are designated by identical references throughout the drawings; and in which.

DETAILED DESCRIPTION OF THE INVENTION

Figure 2:
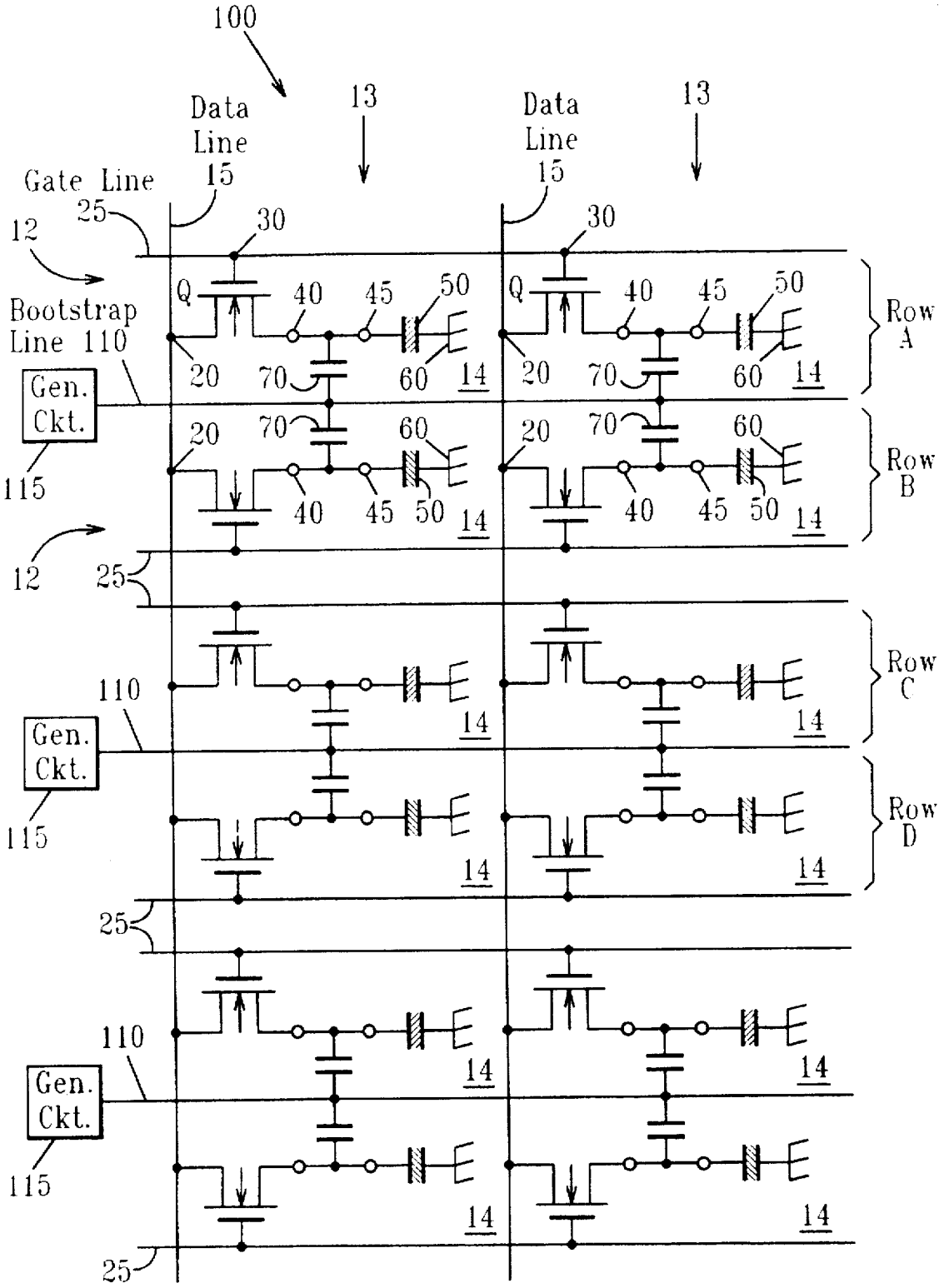
FIG. 2 is a circuit diagram of an AMLCD array in accordance with the present invention.

FIG. 2 shows a display, such as an AMLCD array 100, according to one embodiment of the present invention. The AMLCD array 100 comprises rows 12 and columns 13 of pixel assemblies 14 arranged as a matrix. Each pixel assembly 14 includes display elements or pixels 50, and a semiconductor device Q. Each pixel 50 has a display or pixel electrode 45 and a counter electrode 60. Illustratively, the counter electrodes 60 are connected together and are referred to as a common electrode. The display or pixel electrode 45 of each display elements or pixel 50 is connected to an output 40 of a corresponding semiconductor device Q, such as a thin film transistor (TFT), for example. A data line 15 connects inputs 20 of a column 13 of TFTs Q, and a gate line 25 connects transistor control ports, e.g., gates 30, of a row 12 of TFTs Q. Each TFT column and row has its own dedicated data and gate lines 15, 25, respectively.

Figure 1:
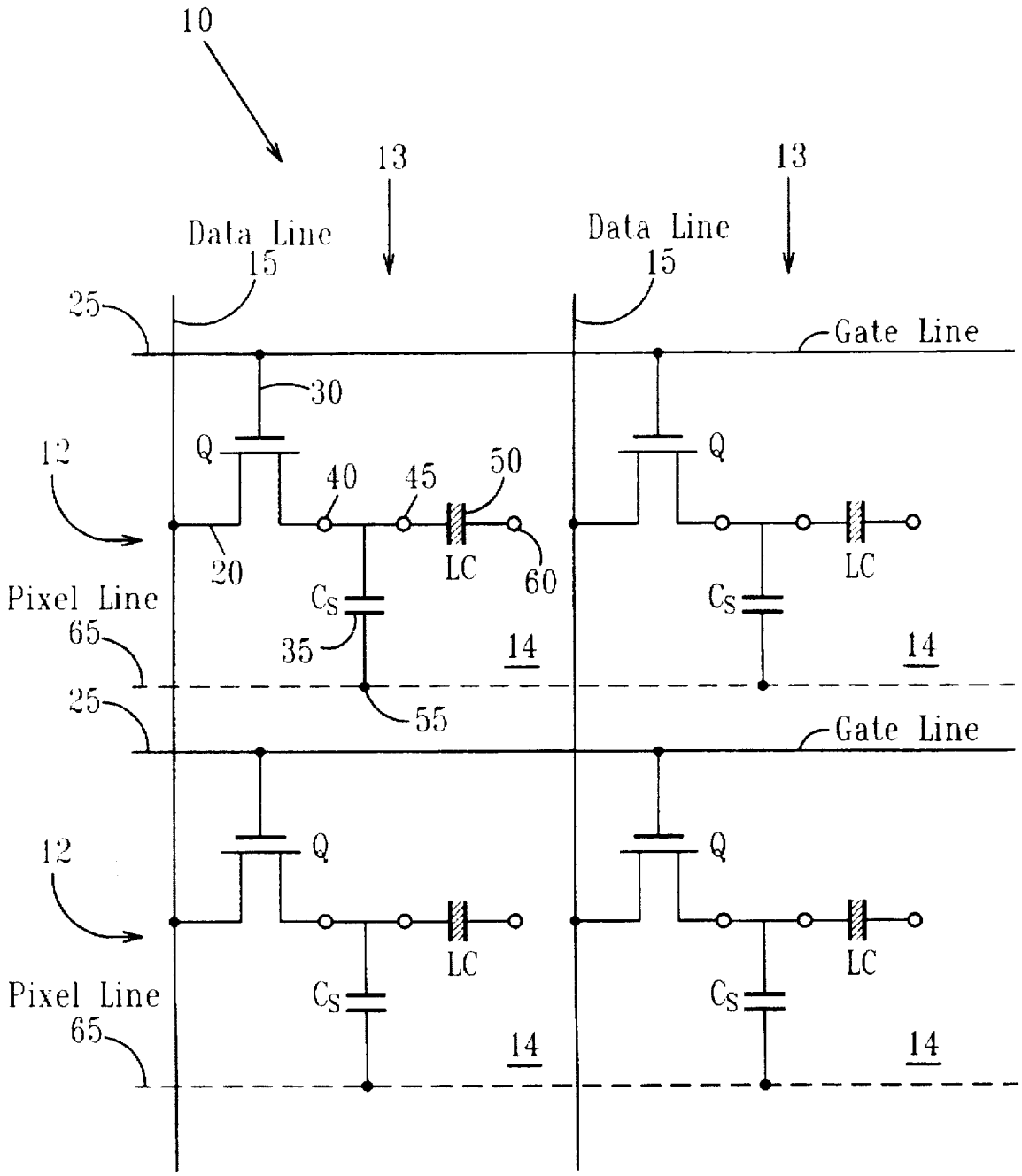
FIG. 1 (PRIOR ART)
FIG. 1 is a circuit diagram of a conventional AMLCD array.

Additional bootstrap lines 110, threading the array parallel to the gate lines 25, are connected, e.g., capacitively coupled, to the pixel electrodes 45 arranged in the rows. The bootstrap lines 110 replace the storage capacitance electrodes 55 which are often used in conventional AMLCDs shown in FIG. 1. The capacitance between each pixel electrode 45 and bootstrap line 110, represented as a capacitor 70 in FIG. 2 for each pixel assembly 14, provides a dual function. One function of the capacitors 70 is storing changes, which is the same function as that of the storage capacitors 35 of the conventional AMLCD 10 shown in FIG. 1. The additional function of the capacitor 70 is coupling bootstep pulses from the bootstrap lines 110 to the pixel electrodes 45. Unlike conventional AMLCD'S, the gate lines 25 of the AMLCD array 100 do not serve as storage capacitance electrodes for pixel assemblies of adjacent rows. Rather, the gate lines 25 only provide gate pulses to control switching of the TFTs Q.

As shown in FIG. 2, each bootstrap line 110 may couple to the row of pixels above and below it, so the number of such lines 110 is half the number of pixel rows. This conserves layout area and reduces the size of the AMLCD array 100. Alternatively, each bootstrap line 100 may serve a single row 12 or more than two rows 12. Each bootstrap line 110 is connected to an individual or common bootstrap pulse timing and generating circuit 115, which may have a conventional design as previously indicated. The pulse timing and generating circuit 115 generate bootstrap pulses shown in FIG. 3*d*.

The voltage range applied to the data lines 15 corresponds to the liquid crystal's zero-to-full transmittance voltage range; about 2.5 V for a typical twisted nematic (TN) liquid crystal (LC). The common electrode 60 receives a fixed potential. Each bootstrap line 110 receives the bootstrap pulses from the pulse timing and generating circuit 115. Each bootstrap pulse has an amplitude large enough to change the pixel voltage, through capacitive coupling for example, by an amount that satisfies the inversion requirement. This pixel voltage shift is equal to the data line voltage range of about 2.5 volts (V), plus twice the liquid crystal threshold voltage of about 2.5 V; that is, about 7.5 V for a typical TNLC. The corresponding bootstrap pulse amplitude is larger than that, i.e., larger than 7.5 V, because of capacitive voltage division; e.g., 8 V. The total pixel voltage range, including the 7.5 V shift, is about 10 V, for example. In this case, the common electrode fixed voltage is about 5 volts.

The pixel assemblies 14 of FIG. 2 are designed to maximize the capacitances 70 relative to the capacitance of pixels 50 and relative to the stray capacitances of the pixel assemblies 14. This minimizes the aforementioned capacitance voltage division, and thereby minimizes the bootstrap pulse amplitude.

The gate pulse amplitude is large enough to minimize TFT leakage in one state, e.g., the OFF state, and to guarantee pixel charging in the other state, e.g., the ON state. Therefore, the gate pulse amplitude brackets the 2.5 V range of the data line voltage.

For comparison, in conventional methods, including the pulsed common electrode method, the pulse must bracket 10 V, the range of the conventional data line voltage instead of the 2.5 V of the present invention. That is, the required gate pulse of most conventional prior art methods must be larger than that of the present invention by about 7.5 V. In the prior art method of Takeda et al. mentioned above, the gate pulse must bracket 6.25 V. Thus, the Takeda et al. gate pulse must be larger than that of the present invention by about 3.75 V.

The operation of the AMLCD 100 will now be described with the aid of the array diagram of FIG. 2, and the waveform and timing diagrams of FIGS. 3*a*–3*i* for the case of two adjacent pixel rows served by a single bootstrap line 110, and assuming that the pixel transistors are n-channel type. Voltages used in the explanation and drawings are illustrative only, based on an LC threshold of 2.5 V, and LC transmittance control range of 2.5 V. The data line voltage range is 0 to 2.5 V and the common electrode is fixed at 5 V.

Figures 3A, 3B, 3C, 3D, 3E, 3F, 3G, 3H, 3I:
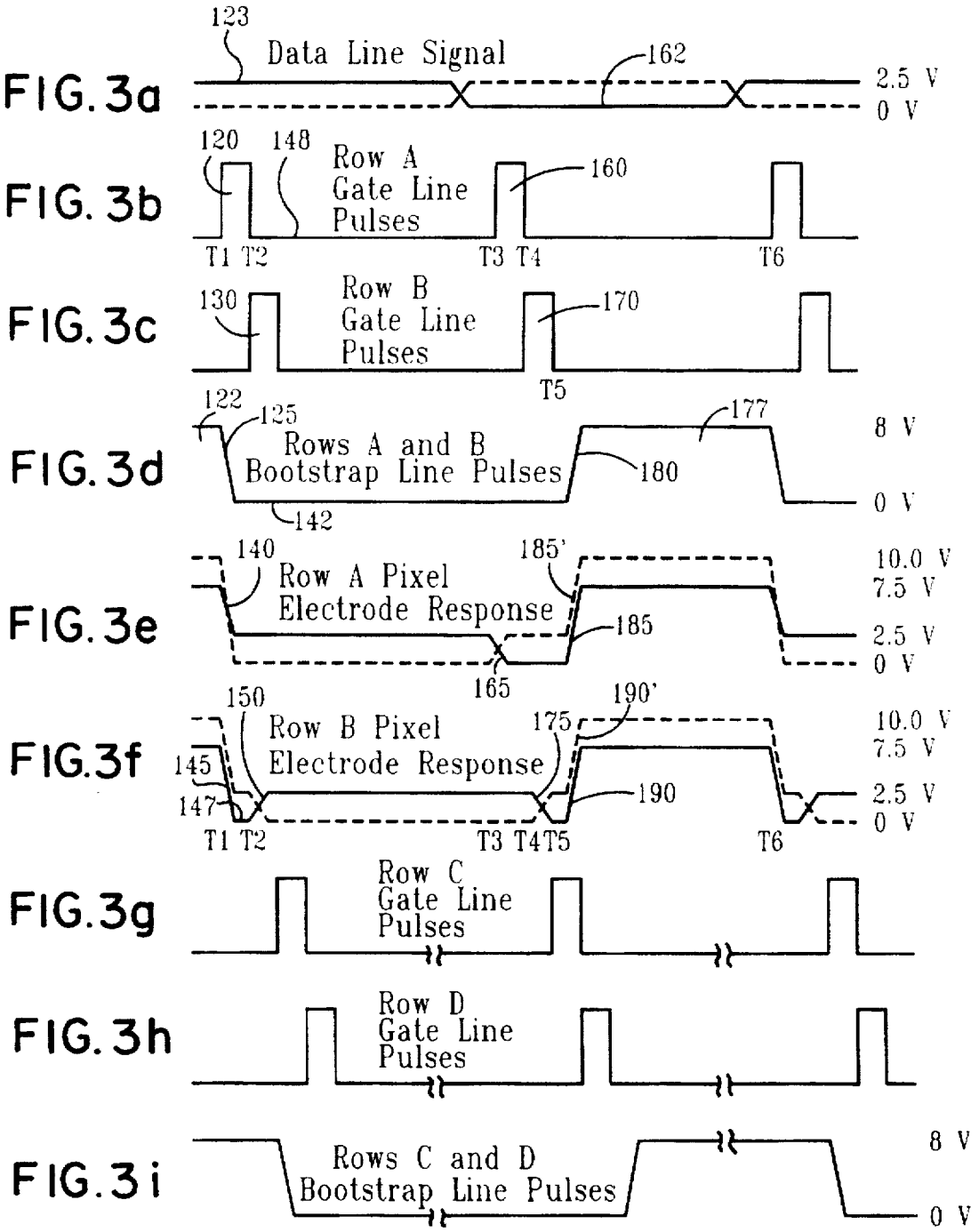
FIGS. 3*a*–3*i* show waveforms at various nodes of the AMLCD array shown in FIG. 2 in accordance with the present invention.

FIGS. 3*a*–3*i* show illustrative timing diagrams of voltage envelopes versus time as follows: FIG. 3*a* is the voltage envelope for the data line signal on the data line 15. The actual date line signal varies within the bounds of the envelope, which bounds are represented by the solid and broken lines in FIG. 3*a*. FIGS. 3*b*, 3*c* show gate line voltage pulses on the gate lines 15 of two adjacent rows, e.g., rows A and B; FIG. 3*d* shows the voltage pulses on the bootstrap line 110 shared by rows A and B; and FIGS. 3*e*, 3*f* show envelopes of voltage waveforms on the pixel electrodes 45 of rows A and B, respectively. The actual pixel electrode waveforms vary within the bounds of the envelope. Note, no voltages are shown for the gate line pulses of FIGS. 3*b* and 3*c*, because they depend upon the type of pixel transistor used; the amplitude of the line pulses is larger for amorphous silicon (a-Si), smaller for polysilicon (p-Si), and even smaller for crystallized silicon (c-Si). Also note, since the bootstrap pulses are capacitively coupled to the pixel electrodes, the DC levels of the pulses have no effect; only their amplitude influence the pixels. The 0 volt and 8 volt high and low bootstrap pulse voltage levels, shown in FIG. 3*d*, are illustrative only. It is the 8 volt voltage range or swing that is significant. Because the bootstrap lines are capacitively coupled to the pixel electrodes 45, the DC component of the bootstrap pulse does not pass through the capacitor 70. Thus, the voltage range between the high and low bootstrap pulse values is important, as opposed to the actual voltage values of the high and low pulse levels.

Although the operation is illustrated in the figures for both bounds of the envelopes, for clarity the following will describe the operation for the solid line bound. However, it is understood by those skilled in the art that the described operation related to the solid bound is similar to the operation for the dotted line bound.

At time T1, a gate pulse 120, shown in FIG. 3*b*, rises on the gate line 25 of row A. At approximately the same time, the pulse 122 on the bootstrap line 110 of rows A and B, shown in FIG. 3*d*, drops in voltage from about 8 V to about 0 V. The row A gate line pulse 120 turns on pixel transistors Q of row A. This causes the pixel voltage at the pixel electrodes 45 of row A to equal the data line voltage.

The bootstrap line pulse 122 of FIG. 3*d* has only a small transient effect (not shown) on the voltage of row A pixels of FIG. 3*e*, because the row A pixel electrodes 45 are clamped to their data line 15 by the ON pixel transistors Q. The voltage change of the row A pixels at this time is due instead to their connection to their data line 15 through their ON transistors Q.

As shown in FIG. 3*e*, the voltage at the row A pixel electrode 45 begins to fall at time T1, and reaches the 2.5 V voltage level of the data line pulse 123 on the data line 15, shown in FIG. 3*a*. This row A pixel electrode pulse falling edge is shown in FIG. 3*e* as reference numeral 140. Pixel transistors Q of row B are OFF during this time, so the voltages at the row B pixel electrodes 45 are pulled down capacitively to about 0 V by the falling edge 125 of the bootstrap line pulse of the bootstrap line pulse 122, but only for the brief time from T1 to time T2 as explained below.

As shown in FIG. 3*f*, the voltage at the row B pixel electrode 45 begins to fall at time T1, and reaches its 0 volt level 147. This row B pixel electrode pulse falling edge is shown in FIG. 3*f* as reference numeral 145.

Soon afterwards, at time T2, the row A gate pulse 120, falls, and the row B gate pulse 130 rises. The low level 148 of the row A gate line pulse 120 (FIG. 3*b*), turns OFF row A transistors Q. Row A pixels are substantially unaffected by the fall of row A gate line pulse 120 and remain at 2.5 V, as shown in FIG. 3*e*. This is because the row A pixels 50 are isolated by their OFF transistors Q. In addition, coupling of the negative edge of the gate line pulse 120 to the row A pixels 50, through stray capacitance, is negligible.

The high row B gate pulse 130 turns ON row B pixel transistors Q. The ON row B transistors Q transfer their data line voltage of 2.5 V, shown in FIG. 3*a*, to their respective pixels 50. Thus, beginning at time T2, the voltage at the row B pixel electrode 45 rises from about 0 V to about 2.5 V, as shown by the rising edge 150 in FIG. 3*f*. Shortly afterwards, as shown in FIG. 3*g*, the row B gate pulse 130 (FIG. 3*b*) ends, and the row C gate pulse rises. This has no substantial effect on pixels of rows A and B. This sequence of pulses is repeated for the remaining rows of the display matrix. The row D gate pulses are shown in FIG. 3*h*. The bootstrap line pulses applied to the remaining bootstrap lines have the same timing relationship to their corresponding gate line pulses as the rows A and B bootstrap line pulses have to the rows A and B gate line pulses. The rows C and D bootstrap pulses are shown in FIG. 3*i*.

Scan of the remaining rows continues (not shown) until, at time T3, the next row A gate pulse 160 rises, to begin a new row scan. This turns ON the row A TFTs Q. The ON row A TFTS Q charge the row A pixels to the data or voltage corresponding to the inverted state, i.e., 0 V shown in FIG. 3*a* as reference numeral 162. However, the inversion does not yet occur. The falling edge 165, shown in FIG. 3*e*, indicates the voltage change of the row A pixel electrodes 45 from 2.5 V to the 0 V level 162 of FIG. 3*a*.

At time T4, the row A gate pulse 160 of FIG. 3*a* falls, thus turning OFF row A TFTs. In addition, at time T4, the next row B gate pulse 170 rises. This turns on the row B TFTs Q, thus transferring the 0 V level 162 of the data line voltage, shown in FIG. 3*a*, to the row B pixel electrode 45. The voltage change of the row B pixel electrodes 45, from 2.5 V to 0 V, is shown in FIG. 3*f* as the falling edge 175.

At time T5, the row B gate pulse 170 of FIG. 3*c* falls, thus turning OFF row A TFTS. In addition, at or after the end of row B gate pulse 170 of FIG. 3*c*, i.e., at or after time T5, the next bootstrap pulse 177 of rows A and B rises, whose rising edge is shown in FIG. 3*d* as reference numeral 180. This rising edge 180 capacitively pulls up the pixel electrode voltages of rows A and B pixels to complete their inversion relative to the common electrode 60 of FIG. 2.

The bootstrap pulse rising edge 180 (FIG. 3*d*) pulls up the rows A and B pixel electrodes 45 from 0 V to 7.5 V, as shown by the rising edges 185, 190 of FIGS. 3*e* and 3*f*, respectively. The 7.5 voltage change of the rows A and B pixels of FIGS. 3*e*, 3*f* is almost the 8 V voltage change of the bootstrap pulse 177 of FIG. 3*d*. The difference of about 0.5 V is due to capacitive voltage division.

For the complimentary boundary or envelope of the data line signal, shown as dotted lines in FIG. 3*a*, where the bootstrap pulse rising edge 180 (FIG. 3*d*) occurs, the rows A and B pixel voltages (shown as dotted lines in FIGS. 3*e*, 3*f*) change from 2.5 V to 10 V, i.e., a 7.5 V change. This is shown in FIGS. 3*e* and 3*f* by the rising edges 185', 190' of the rows A and B pixel pulses, respectively. At time T6, the sequence repeats again, i.e., time T6 corresponds to time T1. The state of row A pixels is erroneous from T3 to T5 (2 line times), and the state of row B pixels is erroneous from T1 to T2 and from T4 to T5 (each line time). These errors are negligible if the number of lines in the display is large.

When the number of rows served by each bootstrap line 110 is increased to more than two, the errors mentioned above increase as the number of rows served by each bootstrap line increases. Instead of serving at least two rows, each bootstrap line 110 may also serve only a single row.

In an alternative embodiment, the rising edge 180 of the bootstrap line pulses shown in FIG. 3*d*, may occur after the fall of the first row B gate line pulse 130, rather than the fall of the second pulse 170.

In another embodiment, the row B gate line pulses 130, 170 may begin before the end of the row A gate line pulses 120, 160. In this embodiment, the falling edge 125 (FIG. 3*d*) of the bootstrap line pulse could thereby coincide with both gate line pulses 120, 130 (FIGS. 3*b*, 3*c*).

The foregoing descriptions have, for clarity, focused on the example of frame inversion. However, this teaching will enable one skilled in the art to affect minor changes in the relative timing of bootstrap pulses between successive bootstrap lines to perform other inversion schemes, e.g., row-pair inversion. While such relative timing may vary depending upon the inversion scheme, the timing of the bootstrap line pulses on each bootstrap line relative to its associated gate line pulses remains as described herein.

A distinction from the prior art method of Takeda et al., which distinction is responsible for the lower gate line voltage range of the present invention, is the following: In the inventive AMLCD 100, bootstrap line pulse edges of one polarity, e.g., the falling edge 125 (FIG. 3*d*), occurs during or immediately preceding the corresponding gate line pulses 120, 130 (FIGS. 3*b*, 3*c*), while the other polarity edges, e.g., the rising edge 180 (FIG. 3*d*), occurs immediately following the corresponding gate line pulses 160, 170 (FIGS. 3*b*, 3*c*). Thus, pixel voltages are capacitively shifted in only one direction, e.g., positively, by the bootstrap pulses. Note that a negative edge 145, shown in FIG. 3*f*, occurs in the row B pixel electrode when the bootstrap pulse falls at time T1. However, this is only a transient effect as the row B pixel electrode switches to the data line signal voltage when the row B gate line pulse rises at time T2. The falling edge 125 of the bootstrap line pulse, shown in FIG. 3*d*, does not shift (more than transiently) the voltage of the pixel electrodes of FIGS. 3*e* and 3*f*.

In the case in which the bootstrap pulse falling edge 125 occurs immediately before, rather than during, one or both gate line pulses 120 and 130 of FIGS. 3*a*, 3*b*, the bootstrap pulse falling edge 125 has a transient effect on the corresponding pixel voltage, as shown by the transient low level 147 in FIG. 3*f*. However, this transient low level 147 does not significantly affect the operation of the display.

The rising edge 180 of the bootstrap pulse, shown in FIG. 3*d*, does shift the pixel voltage positively, as edges 185 and 190 shown in FIGS. 3*e* and 3*f*.

Another distinction from Takeda et al. is that the invention optionally uses independent bootstrap pulse lines 110 and generators 115 which are less in number than the number of rows in the array.

While the invention has been particularly shown and described with respect to illustrative and preferred embodiments thereof, it will be understood by those skilled in the art that the foregoing and other changes in form and details may be made therein without departing from the spirit and scope of the invention which should be limited only by the scope of the appended claims.

Having thus described our invention, what we claim as new, and desire to secure by Letters Patent is:

1. A display comprising:

a plurality of pixel assemblies arranged in a matrix of rows and columns, each of said pixel assemblies including a display element having a display electrode, and a semiconductor device having a control port, an input port and an output port, each of said output ports being connected to a corresponding display electrode;

a plurality of bootstrap lines each connected to said display electrodes of at least two rows of said pixel assemblies;

a plurality of gate lines each connected to said control ports arranged in one of said rows;

a plurality of data lines each connected to said input ports arranged in one of said column; and a bootstrap pulse timing and generating circuit connected to each bootstrap line to provide a bootstrap pulse having a timing relationship with gate line pulses on said plurality of gate lines, said timing relationship causing said bootstrap pulse to shift voltages on said display electrodes in only one direction; wherein a first edge of said bootstrap pulse shifts said voltages on said display electrodes in said only one direction and the following edge of said bootstrap pulse is in the opposite direction of said first edge and has substantially no effect on said voltages.

2. The display of claim 1, further comprising a bootstrap pulse timing and generating circuit connected to each bootstrap line to provide a bootstrap pulse having a first edge of a first polarity occurring one of before and during a first gate pulse carried on said gate line, and a second edge of a second polarity occurring one of after said first gate line pulse and after a second gate line pulse that occurs after said first gate line pulse.

3. The display of claim 1, wherein each of said bootstrap lines is capacitively connected to said display electrodes in said adjacent rows.

4. The display of claim 1, wherein said semiconductor devices are thin film transistors.

5. A method of driving a display comprising the steps of:

generating a bootstrap pulse on bootstrap lines each connected to display electrodes of at least two rows of a plurality of display elements of pixel assemblies arranged in a matrix of rows and columns;

generating gate pulses on gate lines each connected to control ports of semiconductor devices of said pixel assemblies arranged in said rows, each of said semiconductor devices having an output port connected to a corresponding display electrode said bootstrap pulse having a timing relationship with said gate pulses, said timing relationship causing said bootstrap pulse to shift voltages on said display electrodes in only one direction, wherein a first edge of said bootstrap pulse shifts said voltages on said display electrodes in said only one direction and the following edge of said bootstrap pulse is in the opposite direction of said first edge and has substantially no effect on said voltages; and generating data pulses on data lines each connected to input ports of said semiconductor devices arranged in said columns.

6. The method of claim 5, wherein said bootstrap pulse generating step generates said bootstrap pulse having a first edge of a first polarity occurring one of before and during a first gate pulse carried on said gate lines, and a second edge of a second polarity occurring one of after said first gate line pulse and after a second gate line pulse that occurs after said first gate line pulse.

7. A method of driving a display comprising the steps of:

generating a bootstrap pulse on bootstrap line connected to display electrodes of a row of pixel assemblies;

generating a first gate pulse and a second gate pulse on a line connected to control ports of semiconductor devices of said row, said second gate pulse occurring after said first gate pulse; said bootstrap pulse having a first edge of a first polarity occurring one of before and during said first gate pulse, and a second edge of a second polarity occurring one of after said first gate pulse and after said second gate pulse, each of said semiconductor devices having an output port connected to a corresponding display electrode; and generating data pulses on a data line connected to input ports of said semiconductor devices arranged in a column of said pixel assemblies.

8. The method of claim 7, wherein said bootstrap pulse generating step generates said bootstrap pulse that shifts voltages on said display electrodes in only one direction.

* * * * *